United States Patent [19]

Hansen et al.

[11] 3,968,729

[45] July 13, 1976

[54] FLUID-OPERATED APPARATUS EXHIBITING HYSTERESIS EFFECT

[75] Inventors: Kenneth P. Hansen, Enfield; Dean H. Crombie, Ellington, both of Conn.

[73] Assignee: United Technologies Corporation, Hartford, Conn.

[22] Filed: Oct. 29, 1974

[21] Appl. No.: 518,491

[52] U.S. Cl. ..... 91/32; 91/461; 137/625.4

[51] Int. Cl.[2] ..... F15B 13/042

[58] Field of Search ..... 91/461, 32, 33; 137/625.6, 625.61, 625.66, 85, 625.4

[56] References Cited

UNITED STATES PATENTS

| | | | |
|---|---|---|---|
| 2,825,361 | 3/1958 | Seljos | 137/85 X |
| 2,835,265 | 5/1958 | Brandstadter | 137/85 X |
| 2,962,002 | 11/1960 | Hayner | 137/85 X |
| 2,989,950 | 6/1961 | Lockman | 137/85 X |
| 3,052,254 | 9/1962 | Parks | 137/85 |

*Primary Examiner*—Irwin C. Cohen
*Attorney, Agent, or Firm*—John D. Del Ponti

[57] ABSTRACT

A fluid-operated apparatus receiving an input pressure signal exhibits a hysteresis or deadband effect by responding to an increasing pressure signal at a first level and a decreasing signal at a second and lower level. The apparatus includes a spool valve to which the input pressure signal is applied at one end of the spool. The opposite end of the spool having a given cross sectional area projects into a pressure chamber and contacts the poppet of a poppet valve held closed by a regulated pressure in opposition to forces produced by the spool. The seat of the poppet valve surrounds an opening into the pressure chamber so that the regulated pressure is admitted into the pressure chamber when the spool pushes the poppet open. The effective area of the valve seat is greater than the cross sectional area of the spool end engaging the poppet so that the force or input pressure signal required to move the spool and open the poppet valve is greater than that which permits the spool to return and close the poppet valve. A hysteresis or deadband effect determined by the different cross sectional areas is manifested by the spool movements and a hydraulic mechanism controlled by those movements.

5 Claims, 3 Drawing Figures

FLUID-OPERATED APPARATUS EXHIBITING HYSTERESIS EFFECT

BACKGROUND OF THE INVENTION

The present invention relates to a fluid-operated apparatus having a hysteresis effect. In particular, the apparatus responds to a variable input pressure signal by producing distinct output signals at a first increasing signal level and a second decreasing signal level.

In many fluid-operated systems, it is desirable to provide distinctly different output signals only when a modulated pressure signal is above or below predefined levels. One prior art system having an output response of this type is found in U.S. Pat. No. 3,106,623 to Lynn. The apparatus in this patent, while providing a hysteresis characteristic is relatively complex in operation and structure with multiple valve seats, each of which must be clean and aligned with other structure for correct operation of the apparatus.

It is, accordingly, a general object of the present invention to provide an improved, fluid-operated apparatus providing a hysteresis effect without the complexity of the prior art devices.

SUMMARY OF THE INVENTION

The present invention resides in a fluid operated apparatus which exhibits a hysteresis or deadband effect and, more particularly, an apparatus which responds to an increasing pressure at one signal level and a decreasing pressure at a different and lower signal level.

The apparatus is comprised of a housing having a bore in which a shuttle member or spool slides back and forth in response to pressures applied to the opposite ends of the spool. An input pressure is applied to the one end of the member while the opposite end is exposed in a pressure chamber into which fluid is admitted by valve means. The valve means is preferably a poppet valve which engages and is opened by the spool when an input pressure at the opposite end of the spool reaches a first level.

The pressure chamber is connected with means for restrictively draining pressurized fluid from the chamber and, therefore, when the valve means is closed, the input pressure required to open the poppet is determined by the cross sectional area of the valve seat. When the valve is opened, pressurized fluid fills the chamber and operates on the exposed end of the spool. If the input pressure is subsequently reduced to a second level, the spool returns to its initial position. By selecting the cross sectional areas of the valve seat and the exposed end of the spool in relation to one another, different input pressure levels at which the spool is shuttled in each direction may be established. Accordingly, the apparatus will exhibit a hysteresis or deadband effect between the different pressure levels.

DETAILED DESCRIPTION

Figure 1:
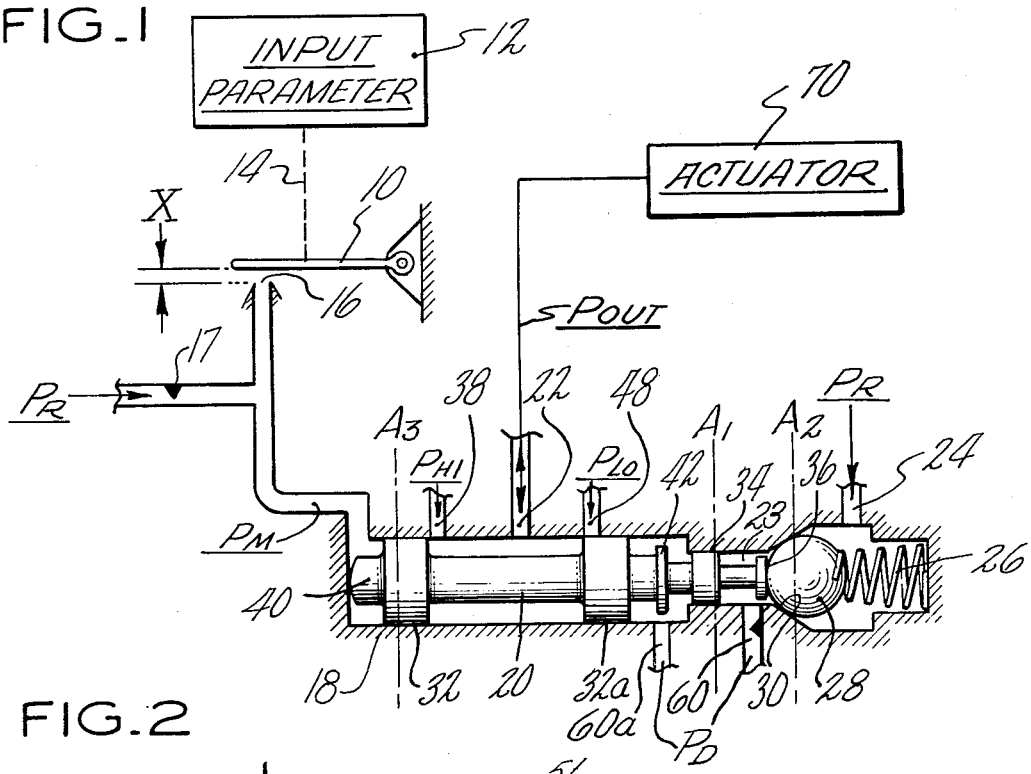
FIG. 1 is a schematic representation of a spool valve constructed in accordance with the present invention in a typical environment including a flapper valve and orifice assembly providing a controlled input pressure signal to the input end of the spool valve.

FIG. 1 shows a control system which includes a conventional fluid flapper valve having a flapper 10 which moves in response to an input parameter, such as indicated schematically at 16, through an intermediate linkage or the like, as indicated generally at 14. The flapper 10 is located in a chamber (not shown) at a vent or drain pressure, $P_D$. Displacement of the flapper 10 with respect to an orifice 16 is represented by the variable X in the description to follow.

Figure 3:
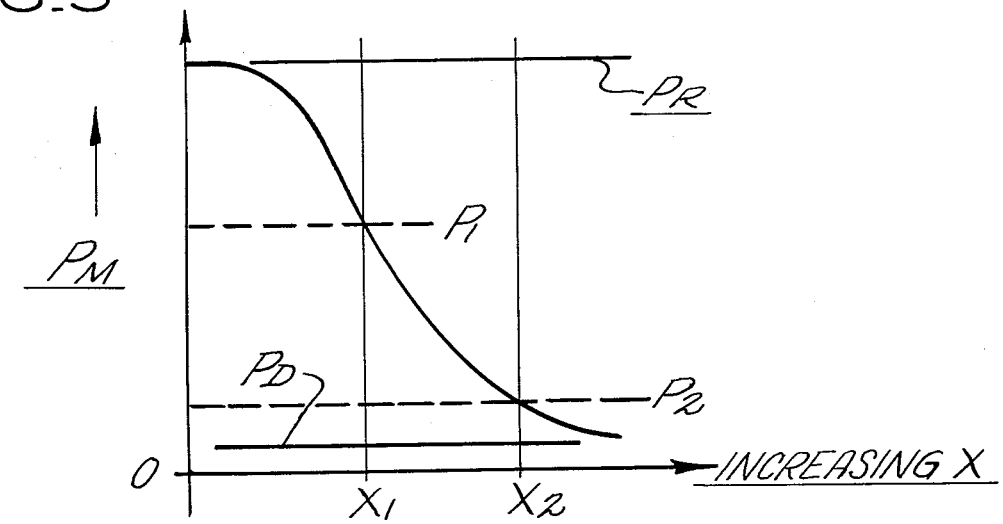
FIG. 3 is a graphical presentation of the input pressure signal plotted against displacement of the flapper.

A source of pressurized hydraulic fluid at a regulated reference pressure $P_R$ communicates through a fixed orifice 17 with the flapper orifice 16 and through another passageway to a bore in a spool valve housing 18. Variations in flapper displacement X will be accompanied by modulations of the input pressure signal $P_M$ at the left-hand end of the shuttle member of spool 20 in the bore of the housing 18. The relationship between the input pressure signal $P_M$ and the displacement X is illustrated in FIG. 3 wherein the maximum pressure signal is $P_R$ when the displacement X is zero. The pressure signal decreases as the displacement X increases and asymptotically approaches the drain pressure $P_D$. For reference purposes a pressure $P_1$ will correspond to a displacement $X_1$ and a pressure $P_2$ will correspond to a displacement $X_2$ greater than $X_1$.

With particular reference to FIG. 1 and with spool 20 in the position shown, an output pressure signal $P_{OUT}$ in line 22 is derived through ports in the housing bore from a high pressure source $P_{HI}$ in line 38 and is applied to an associated device such as an actuator 70. When as a result of an increase in the input pressure $P_M$ the spool 20 shifts from the left hand position shown against a stop 40 to a new position to the right limited by the stop 42, the port for the line 38 is shut off by the spool land 32, and the port of line 48 connected with a different source $P_{LO}$ is placed in communication with the port of line 22 and the actuator 70. Therefore, shuttling the spool 20 back and forth in the housing 20 between positions limited at the left by the stop 40 and at the right by the stop 42 causes the output pressure signal $P_{OUT}$ to change in a stepwise manner between two levels.

The pressure level $P_1$ necessary for the input signal $P_M$ to shift the spool 20 to the right in FIG. 1 is determined by the restoring force on the opposite end of the spool 20. The restoring force is determined in part by the pressure in the pressure chamber 23 at the opposite end of the bore in the housing 18. The pressure chamber 23 is connected to an orificed line 60 leading to the drain pressure $P_D$ for restrictively draining pressurized fluid from the chamber. Another line 68*a* drains the bore chamber containing the limit stop 42 to insure that no restoring forces are developed in this chamber by virtue of fluid leaking past the lands 32*a* and 34 on the spool 20.

A poppet or ball valve having a poppet or ball 28, the annular valve seat 30 and a coil spring 26 is placed at an opening in the pressure chamber 23 to control the admission of fluid at the regulated pressure $P_R$ from the upstream or right-hand side of the ball 28 and the line 24. The spool 20, the pressure chamber 23 and the ball valve are so aligned that the right-hand end 36 of the spool engages the ball 28. To push the ball away from the seated position and allow fluid at the regulated pressure $P_R$ to pass from the line 24 through the annular seat 30 and into the chamber 23, the input pressure signal $P_M$ must overcome the restoring force on the spool produced by the coil spring 26 and the regulated pressure $P_R$ holding the ball against the valve seat 30 having an effective area $A_2$. After the ball 28 has been pushed open by the spool, effectively the full magnitude of the pressure $P_R$ is applied to the end of the spool in chamber 23 since the orifice in the drain line 60 is relatively small. The effective cross sectional area of the spool on which the chamber pressure operates is designated $A_1$ in FIG. 1.

From the above, therefore, the effective cross sectional area $A_2$ of the valve seat 30 and the regulated pressure $P_R$ together with a slight biasing force produced by the coil spring 26 determine the pressure level of the input signal $P_M$ which shifts the spool from the illustrated position to the right in FIG. 1 and drops the output pressure $P_{OUT}$ to the pressure of the source $P_{LO}$. On the other hand, the area $A_1$ and the regulated pressure $P_R$ together with the slight biasing force provided by the coil spring 26 determine the pressure level of the input pressure signal $P_M$ at which the spool is moved back to the position illustrated in FIG. 1 to raise the output pressure $P_{OUT}$ to the pressure of the source $P_{HI}$. Thus by selecting the areas $A_1$ and $A_2$ relative to one another, the levels of the input pressure signal $P_M$ at which the output pressure $P_{OUT}$ switches between the sources $P_{HI}$ and $P_{LO}$ can be controlled. For example, the area $A_2$ is larger than the area $A_1$ and, hence, the increasing input pressure signal level needed to move the spool 20 to the right must be higher than the decreasing pressure signal which moves the spool to the left. The effective cross sectional area $A_3$ of the spool 20 at the left-hand end must be only slightly larger than the area $A_2$ of the valve seat 30 in order to move the spool 20 to the right when the displacement X is zero because the pressure $P_R$ is then operating on both of the areas $A_2$ and $A_3$. If the regulated pressure applied through the line 24 is adjustable relative to the regulated pressure upstream of the orifice 17 from which the modulated pressure $P_M$ is developed by the flapper 10, then all of the areas $A_1$, $A_2$ and $A_3$ can be changed to locate critical input pressure levels at any desired pressures not exceeding $P_R$.

Figure 2:
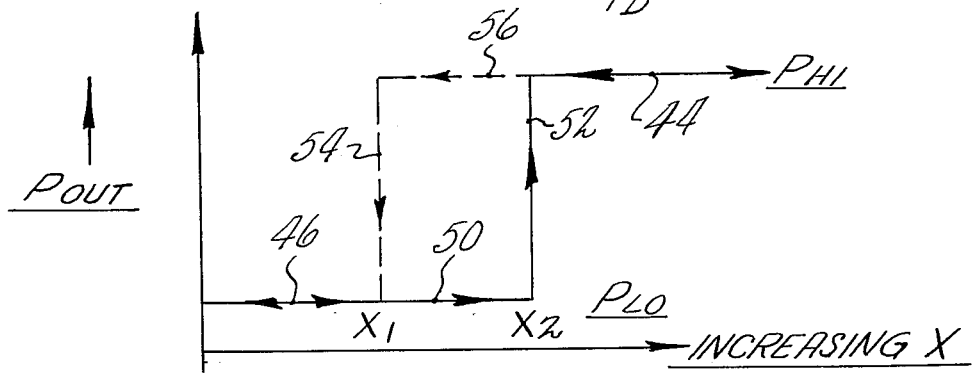
FIG. 2 is a graph illustrating the hysteresis effect of the spool valve shown in FIG. 1 whereby the output pressure from the spool valve switches between a high pressure and a low pressure depending upon the displacement of the flapper from the orifice, the arrowheads on the plot illustrating the effect of increasing and decreasing the flapper displacement.

FIGS. 2 and 3 illustrate the variations in the output pressure signal and input pressure signal respectively as a function of the flapper position X. Assuming that the spool is in its illustrated position and the flapper position is at some maximum and is decreasing, the input pressure signal $P_M$ in FIG. 3 increases through the level $P_1$ and asymptotically approaches the maximum pressure $P_R$. The output pressure signal $P_{OUT}$ during this same interval varies from $P_{HI}$, illustrated in FIG. 2 by the portion 44 of the plot, to $P_{LO}$, illustrated by the portion 46 of the plot, by traversing the dashed portions 56 and 54 in the direction of the arrowheads on those portions. At displacement $X_1$ and input pressure level $P_1$, the forces developed by the increasing input pressure signal $P_M$ are adequate to overcome the restraining forces developed by the coil spring 26 and the ball 28 under the influence of the pressure $P_R$ and, thus, the spool 20 is shuttled to change the output pressure $P_{OUT}$.

If the movement of the flapper 10 is now reversed to increase the displacement X through $X_2$, the input pressure signal $P_M$ decreases through the level $P_2$ and asymptotically approaches the drain pressure $P_D$. When $P_M$ drops below the level $P_2$, pressure in the chamber 23 forces the spool 20 back to the position illustrated in FIG. 1. Correspondingly, the output pressure signal $P_{OUT}$ changes from $P_{LO}$ to $P_{HI}$ as seen by traversing the plot in FIG. 2 along the portions 50 and 52 between the portions 46 and 44.

It will be noted that the plot in the graph of FIG. 2 is a hysteresis curve and thus the spool valve and poppet valve illustrated in FIG. 1 and forming the apparatus of the present invention exhibit a hysteresis characteristic. It will also be recognized that perturbations of the input pressure signal $P_M$ between the levels $P_1$ and $P_2$, not including these levels, will have no effect on the spool position and, hence, the apparatus displays a deadband characteristic between these levels.

While the present invention has been described in a preferred embodiment, it should be understood that numerous modifications and substitutions can be had without departing from the spirit of the invention. For example, the output of the apparatus has been illustrated as a pressure signal. The apparatus is not so limited, however, and it is contemplated that other signals such as electric signals or mechanical signals may be derived from the spool 20. It should also be understood that while a flapper valve has been utilized to develop the input pressure signal, other pressure modulating devices may be utilized. Accordingly, the present invention has been described in a preferred embodiment by way of illustration rather than limitation.

We claim:

1. A fluid operated control apparatus for selecting output signals from a plurality of sources and exhibiting a predefined hysteresis effect in response to an input pressure signal comprising:

An input pressure signal, a housing having an internal bore with a passageway to receive the input pressure signal and direct the pressure signal into one end of the bore, and a pressure chamber at the opposite end of the bore;

first pressure source signal means communicating a first signal at a first pressure level to said bore;

second pressure source signal means communicating a second signal at a second pressure level to said bore;

actuator means responsive to said first and second pressure source signals;

output means communicating said bore with said actuator means for conveying said first and second pressure source signals to said actuator means; and a shuttle member mounted within the housing bore for sliding movement between a first and second position and having one end exposed to the input pressure signal received at said one end of the bore and an opposite end of a first predefined cross sectional area exposed to a pressure in the pressure chamber at said opposite end of the bore, said shuttle member having first and second land means thereon between said one end and said opposite end, one of said first and second land means communicating said first signal with said output means when said shuttle member is in said first position and the other of said first and second land means communicating said second signal with said output means when said shuttle member is in said second position;

means for continuously restrictively draining pressurized fluid from the pressure chamber; a regulated pressurized fluid;

valve means communicating with the pressure chamber for admitting the regulated pressurized fluid to the pressure chamber and exposing said opposite end of the shuttle member to the pressurized fluid, the valve means including a valve seat having a second predefined cross sectional area, a biased closed valve element engaging the valve seat, and a movable valve member cooperating with the valve element to open the valve element and admit pressurized fluid into the pressure chamber, the valve member being connected with said opposite end of the shuttle member for movement between opened and closed positions of the valve element in response to pressure forces developed by the input pressure signal on said one end of the shuttle member, the second predefined cross sectional area of the valve seat and the first predefined cross sectional area of said opposite end of the shuttle member being selected relative to one another to move the shuttle member in one direction to one of said first and second positions and open the valve means at a first input pressure signal level and to move the shuttle member in the opposite direction to the other of said first and second positions and close the valve means in response to the pressurized fluid in the chamber at a second input pressure signal level different from the first level.

2. A fluid-operated control apparatus as defined in claim 1 wherein:

the valve element comprises a poppet valve.

3. A fluid-operated control apparatus as defined in claim 2 wherein:

the poppet is a ball;

the valve seat is an annular seat at an opening in the pressure chamber; and a spring is included for urging the ball toward the valve seat and said opposite end of the shuttle member.

4. A fluid-operated control apparatus as defined in claim 1 wherein:

the movable member of the valve means connected to said opposite end of the shuttle member is smaller than the second predefined cross sectional area of the valve seat.

5. A fluid-operated control apparatus as defined in claim 1 wherein the means for continuously restrictively draining includes an orificed fluid passageway communicating with the pressure chamber.

* * * * *